US006607422B1

(12) United States Patent
Swedek et al.

(10) Patent No.: US 6,607,422 B1
(45) **Date of Patent: *Aug. 19, 2003**

(54) ENDPOINT DETECTION WITH LIGHT BEAMS OF DIFFERENT WAVELENGTHS

(75) Inventors: Boguslaw Swedek, San Jose, CA (US); Andreas Norbert Wiswesser, Freiberg (DE)

(73) Assignee: Applied Materials, Inc., Santa Clara, CA (US)

( * ) Notice: Subject to any disclaimer, the term of this patent is extended or adjusted under 35 U.S.C. 154(b) by 81 days.

This patent is subject to a terminal disclaimer.

(21) Appl. No.: 09/669,776

(22) Filed: Sep. 25, 2000

Related U.S. Application Data

(63) Continuation of application No. 09/300,183, filed on Apr. 27, 1999, now Pat. No. 6,190,234, which is a continuation-in-part of application No. 09/237,472, filed on Jan. 25, 1999, now Pat. No. 6,247,998.

(51) Int. Cl.[7] ..... B24B 49/12; B24B 7/22
(52) U.S. Cl. ..... 451/6; 451/41
(58) Field of Search ..... 451/6, 5, 41, 288, 451/287

(56) References Cited

U.S. PATENT DOCUMENTS

| | | | |
|---|---|---|---|
| 5,081,796 | A | 1/1992 | Schultz |
| 5,413,941 | A | 5/1995 | Koos et al. |
| 5,433,651 | A | 7/1995 | Lustig et al. |
| 5,461,007 | A | 10/1995 | Kobayashi |
| 5,605,760 | A | 2/1997 | Roberts |
| 5,609,511 | A | 3/1997 | Moriyama et al. |
| 5,640,242 | A | 6/1997 | O'Boyle et al. |
| 5,663,797 | A | 9/1997 | Sandhu |
| 5,672,091 | A | 9/1997 | Takahashi et al. |
| 5,791,969 | A | 8/1998 | Lund |
| 5,816,891 | A | 10/1998 | Woo |
| 5,838,447 | A | 11/1998 | Hiyama et al. |
| 5,872,633 | A | 2/1999 | Holzapfel et al. |
| 5,893,796 | A | 4/1999 | Birang et al. |
| 5,949,927 | A | 9/1999 | Tang |
| 5,964,643 | A | 10/1999 | Birang et al. |
| 6,190,234 | B1 | 2/2001 | Swedek et al. |

FOREIGN PATENT DOCUMENTS

| | | |
|---|---|---|
| EP | 881 040 A2 | 12/1998 |
| EP | 881 484 A2 | 12/1998 |
| JP | 3-234467 | 10/1991 |

*Primary Examiner*—Robert A. Rose
(74) *Attorney, Agent, or Firm*—Fish & Richardson

(57) ABSTRACT

A chemical mechanical polishing apparatus includes two optical systems which are used serially to determine polishing endpoints. The first optical system includes a first light source to generate a first light beam which impinges on a surface of the substrate, and a first sensor to measure light reflected from the surface of the substrate to generate a measured first interference signal. The second optical system includes a second light source to generate a second light beam which impinges on a surface of the substrate and a second sensor to measure light reflected from the surface of the substrate to generate a measured second interference signal. The second light beam has a wavelength different from the first light beam.

23 Claims, 10 Drawing Sheets

ENDPOINT DETECTION WITH LIGHT BEAMS OF DIFFERENT WAVELENGTHS

CROSS-REFERENCE TO RELATED APPLICATIONS

This application is a continuation of U.S. patent application Ser. No. 09/300,183, filed Apr. 27, 1999, now U.S. Pat. No. 6,190,234 which is a continuation-in-part of U.S. patent application Ser. No. 09/237,472, filed Jan. 25, 1999, now U.S. Pat. No. 6,247,998 each of which are incorporated by reference.

BACKGROUND

This invention relates generally to chemical mechanical polishing of substrates, and more particularly to a method and apparatus for detecting a polishing endpoint in chemical mechanical polishing.

An integrated circuit is typically formed on a substrate by the sequential deposition of conductive, semiconductive or insulative layers on a silicon wafer. After each layer is deposited, the layer is etched to create circuitry features. As a series of layers are sequentially deposited and etched, the outer or uppermost surface of the substrate, i.e., the exposed surface of the substrate, becomes increasingly non-planar. This non-planar surface presents problems in the photolithographic steps of the integrated circuit fabrication process. Therefore, there is a need to periodically planarize the substrate surface.

Chemical mechanical polishing (CMP) is one accepted method of planarization. This planarization method typically requires that the substrate be mounted on a carrier or polishing head. The exposed surface of the substrate is placed against a rotating polishing pad. The polishing pad may be either a "standard" pad or a fixed-abrasive pad. A standard pad has a durable roughened surface, whereas a fixed-abrasive pad has abrasive particles held in a containment media. The carrier head provides a controllable load, i.e., pressure, on the substrate to push it against the polishing pad. A polishing slurry, including at least one chemically-reactive agent, and abrasive particles if a standard pad is used, is supplied to the surface of the polishing pad.

The effectiveness of a CMP process may be measured by its polishing rate, and by the resulting finish (absence of small-scale roughness) and flatness (absence of large-scale topography) of the substrate surface. The polishing rate, finish and flatness are determined by the pad and slurry combination, the carrier head configuration, the relative speed between the substrate and pad, and the force pressing the substrate against the pad.

In order to determine the effectiveness of different polishing tools and processes, a so-called "blank" wafer, i.e., a wafer with one or more layers but no pattern, is polished in a tool/process qualification step. After polishing, the remaining layer thickness is measured at several points on the substrate surface. The variations in layer thickness provide a measure of the wafer surface uniformity, and a measure of the relative polishing rates in different regions of the substrate. One approach to determining the substrate layer thickness and polishing uniformity is to remove the substrate from the polishing apparatus and examine it. For example, the substrate may be transferred to a metrology station where the thickness of the substrate layer is measured, e.g., with an ellipsometer. Unfortunately, this process can be time-consuming and thus costly, and the metrology equipment is costly.

One problem in CMP is determining whether the polishing process is complete, i.e., whether a substrate layer has been planarized to a desired flatness or thickness. Variations in the initial thickness of the substrate layer, the slurry composition, the polishing pad material and condition, the relative speed between the polishing pad and the substrate, and the load of the substrate on the polishing pad can cause variations in the material removal rate. These variations cause variations in the time needed to reach the polishing endpoint. Therefore, the polishing endpoint cannot be determined merely as a function of polishing time.

One approach to determining the polishing endpoint is to remove the substrate from the polishing surface and examine it. If the substrate does not meet the desired specifications, it is reloaded into the CMP apparatus for further processing. Alternatively, the examination might reveal that an excess amount of material has been removed, rendering the substrate unusable. There is, therefore, a need for a method of detecting, in-situ, when the desired flatness or thickness had been achieved.

Several methods have been developed for in-situ polishing endpoint detection. Most of these methods involve monitoring a parameter associated with the substrate surface, and indicating an endpoint when the parameter abruptly changes. For example, where an insulative or dielectric layer is being polished to expose an underlying metal layer, the coefficient of friction and the reflectivity of the substrate will change abruptly when the metal layer is exposed.

In an ideal system where the monitored parameter changes abruptly at the polishing endpoint, such endpoint detection methods are acceptable. However, as the substrate is being polished, the polishing pad condition and the slurry composition at the pad-substrate interface may change. Such changes may mask the exposure of an underlying layer, or they may imitate an endpoint condition. Additionally, such endpoint detection methods will not work if only planarization is being performed, if the underlying layer is to be over-polished, or if the underlying layer and the overlying layer have similar physical properties.

In view of the foregoing, there is a need for a polishing endpoint detector which more accurately and reliably determines when to stop the polishing process. There is also a need for an means for in-situ determination of the thickness of a layer on a substrate during a CMP process.

SUMMARY

In one aspect, the invention is directed to a chemical mechanical polishing apparatus to polish a substrate having a first surface and a second surface underlying the first surface. The apparatus has a first polishing station with a first optical system, a second polishing station with a second optical system, at least one processor. The first optical system including a first light source to generate a first light beam to impinge the substrate as it is polished at the first polishing station, and a first sensor to measure light from the first light beam that is reflected from the first and second surfaces to generate a first interference signal. The second optical system includes a second light source to generate a second light beam to impinge on the substrate as it is polished at the second polishing station, and a second sensor to measure light from the second light beam that is reflected from the first and second surfaces to generate a second interference signal. The first light beam has a first effective wavelength, and the second light beam has a second effective wavelength that differs from the first effective wavelength. The processor determines a polishing endpoint at the first and second polishing stations from the first and second interference signals, respectively.

Implementations of the invention may include the following features. The first effective wavelength may be greater than the second effective wavelength. The second light beam may have a second wavelength, e.g., between about 400 and 700 nanometers, that is shorter than a first wavelength, e.g., between about 800 and 1400 nanometers, of the first light beam. A third polishing station may have a third optical system which includes a third light source to generate a third light beam to impinge on the substrate as it is polished at the third polishing station, and a third sensor to measure light from the third light beam that is reflected from the first and second surfaces to generate a third interference signal. The third light beam may have a third effective wavelength that is equal to or smaller than the second effective wavelength. A carrier head may move the substrate between the first and second polishing stations. Each polishing station may include a rotatable platen with an aperture through which one of the first and second light beams can pass to impinge the substrate. Each polishing station may also include a polishing pad supported on a corresponding platen, each polishing pad having a window through which one of the first and second light beams can pass to impinge the substrate.

In another embodiment, the invention is directed to a method of chemical mechanical polishing. In the method, a substrate is polished at a first polishing station, a first interference signal is generated by directing a first light beam having a first effective wavelength onto the substrate and measuring light from the first light beam reflected from the substrate, and a first endpoint is detected from the first interference signal. After detection of the first endpoint, a second interference signal is generated by directing a second light beam having a second effective wavelength onto the substrate and measuring light from the second light beam reflected from the substrate, and a second endpoint is detected from the second interference signal. The second effective wavelength differs from the first effective wavelength.

Advantages of the invention include the following. With two optical systems, an estimate of the initial and remaining thickness of the layer on the substrate can be generated. Employing two optical systems operating at different effective wavelengths also allows more accurate determination of parameters that were previously obtained with a single optical system.

Other features and advantages of the invention will become apparent from the following description, including the drawings and claims.

DETAILED DESCRIPTION

Figure 1:
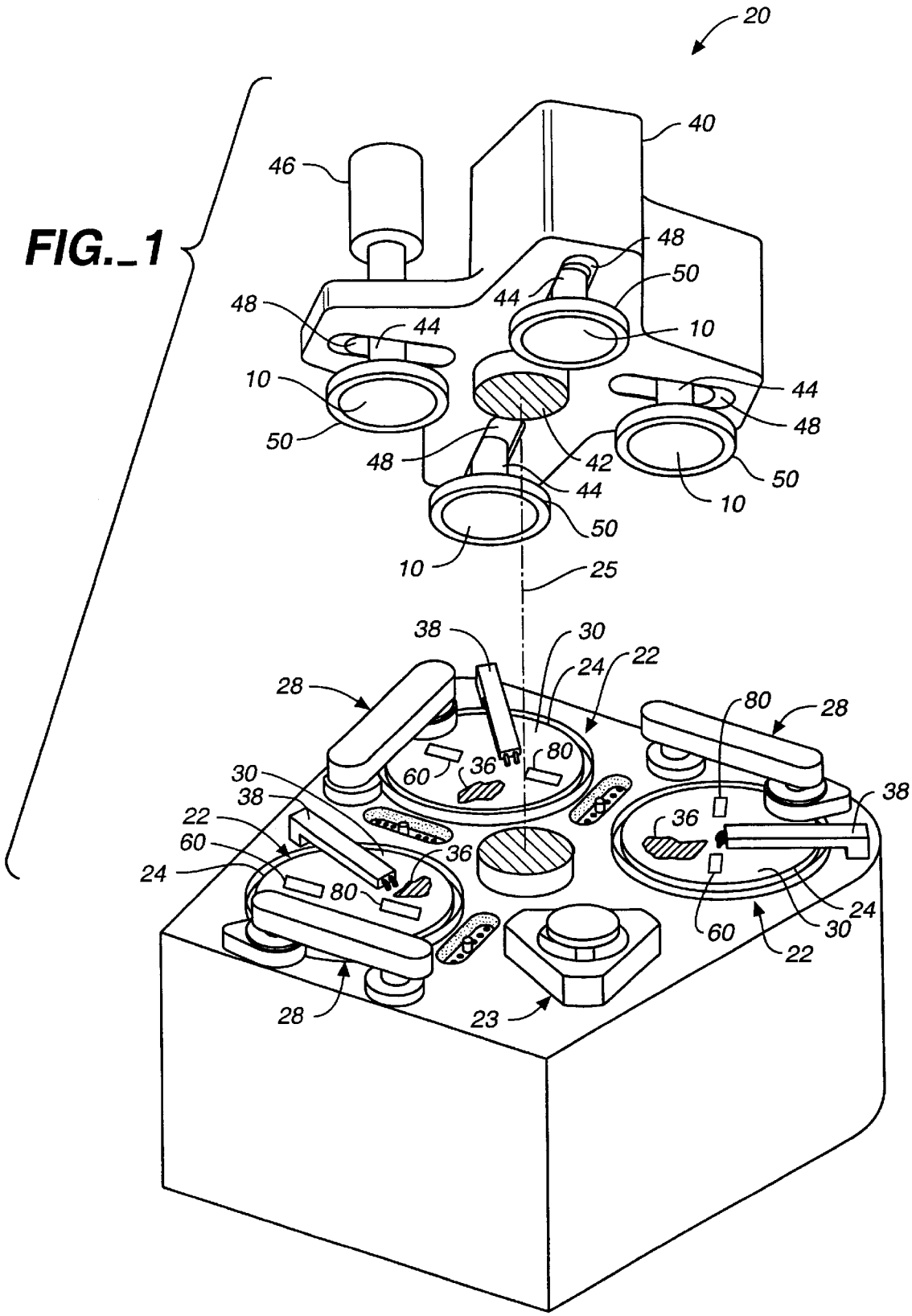
FIG. 1 is a schematic exploded perspective view of a CMP apparatus according to the present invention.
Figure 2:
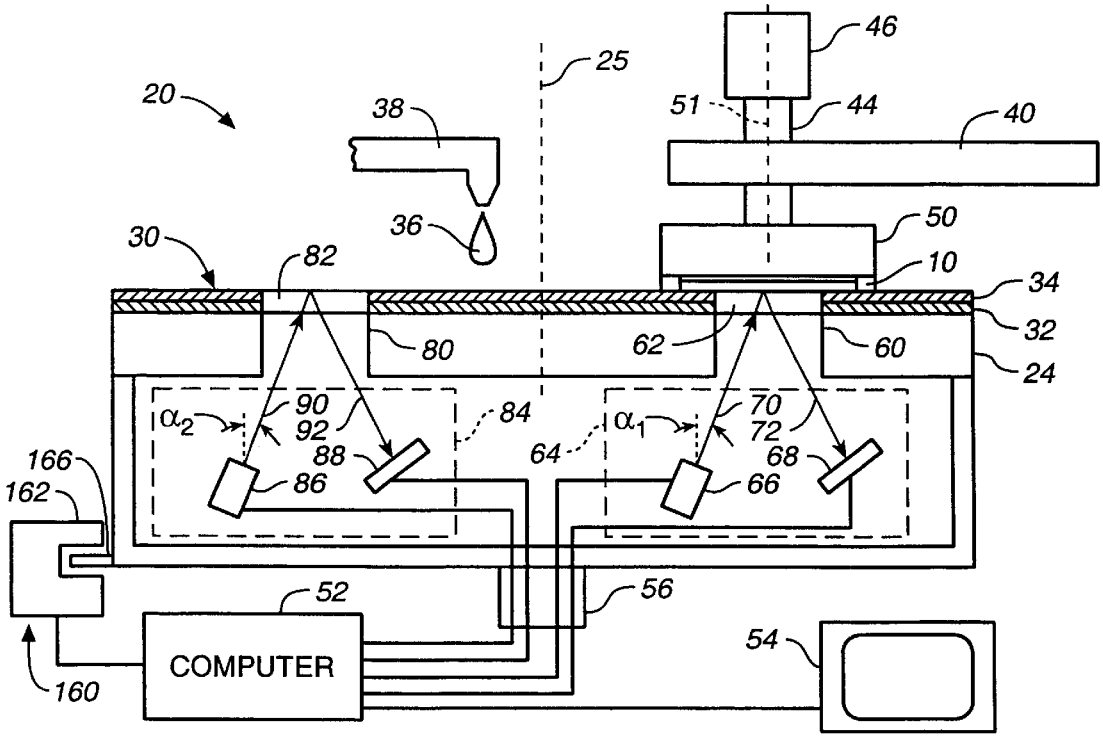
FIG. 2 is schematic view, in partial section, of a polishing station from the CMP apparatus of FIG. 1 with two optical systems for interferometric measurements of a substrate.

Referring to FIGS. 1 and 2, one or more substrates 10 will be polished by a chemical mechanical polishing (CMP) apparatus 20. A description of a similar polishing apparatus may be found in U.S. Pat. No. 5,738,574, the entire disclosure of which is incorporated herein by reference. Polishing apparatus 20 includes a series of polishing stations 22 and a transfer station 23. Transfer station 23 serves multiple functions, including receiving individual substrates 10 from a loading apparatus (not shown), washing the substrates, loading the substrates into carrier heads, receiving the substrates from the carrier heads, washing the substrates again, and finally, transferring the substrates back to the loading apparatus.

Each polishing station includes a rotatable platen 24 on which is placed a polishing pad 30. The first and second stations may include a two-layer polishing pad with a hard durable outer surface, whereas the final polishing station may include a relatively soft pad. If substrate 10 is an "eight-inch" (200 millimeter) or "twelve-inch" (300 millimeter) diameter disk, then the platens and polishing pads will be about twenty inches or thirty inches in diameter, respectively. Each platen 24 may be connected to a platen drive motor (not shown). For most polishing processes, the platen drive motor rotates platen 24 at thirty to two hundred revolutions per minute, although lower or higher rotational speeds may be used. Each polishing station may also include a pad conditioner apparatus 28 to maintain the condition of the polishing pad so that it will effectively polish substrates.

Polishing pad 30 typically has a backing layer 32 which abuts the surface of platen 24 and a covering layer 34 which is used to polish substrate 10. Covering layer 34 is typically harder than backing layer 32. However, some pads have only a covering layer and no backing layer. Covering layer 34 may be composed of an open cell foamed polyurethane or a sheet of polyurethane with a grooved surface. Backing layer 32 may be composed of compressed felt fibers leached with urethane. A two-layer polishing pad, with the covering layer composed of IC-1000 and the backing layer composed of SUBA-4, is available from Rodel, Inc., of Newark, Del. (IC-1000 and SUBA-4 are product names of Rodel, Inc.).

A slurry 36 containing a reactive agent (e.g., deionized water for oxide polishing) and a chemically-reactive catalyzer (e.g., potassium hydroxide for oxide polishing) may be supplied to the surface of polishing pad 30 by a slurry supply port or combined slurry/rinse arm 38. If polishing pad 30 is a standard pad, slurry 36 may also include abrasive particles (e.g., silicon dioxide for oxide polishing).

A rotatable carousel 40 with four carrier heads 50 is supported above the polishing stations by a center post 42. A carousel motor assembly (not shown) rotates center post 42 to orbit the carrier heads and the substrates attached thereto between the polishing and transfer stations. A carrier drive shaft 44 connects a carrier head rotation motor 46 (see FIG. 2) to each carrier head 50 so that each carrier head can independently rotate about it own axis. In addition, a slider (not shown) supports each drive shaft in an associated radial slot 48. A radial drive motor (not shown) may move the slider to laterally oscillate the carrier head. In operation, the platen is rotated about its central axis 25, and the carrier head is rotated about its central axis 51 and translated laterally across the surface of the polishing pad.

The carrier head 50 performs several mechanical functions. Generally, the carrier head holds the substrate against the polishing pad, evenly distributes a downward pressure across the back surface of the substrate, transfers torque from the drive shaft to the substrate, and ensures that the substrate does not slip out from beneath the carrier head during polishing operations. A description of a carrier head may be found in U.S. patent application Ser. No. 08/861,260, entitled a CARRIER HEAD WITH a FLEXIBLE MEMBRANE FOR a CHEMICAL MECHANICAL POLISHING SYSTEM, filed May 21, 1997, by Steven M. Zuniga et al., assigned to the assignee of the present invention, the entire disclosure of which is incorporated herein by reference.

Figure 3:
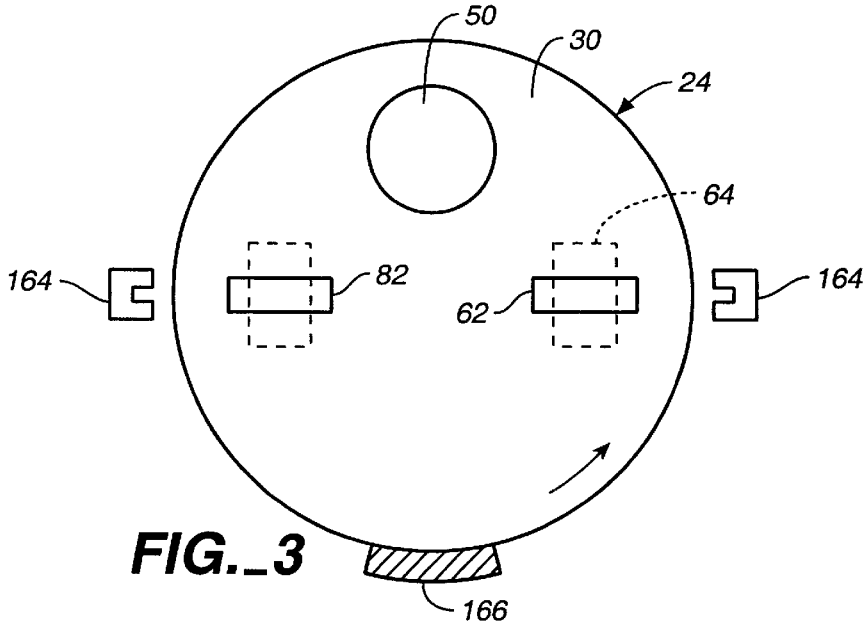
FIG. 3 is a schematic top view of a polishing station from the CMP apparatus of FIG. 1.

Referring to FIGS. 2 and 3, two holes or apertures 60 and 80 are formed in platen 24, and two transparent windows 62 and 82 are formed in polishing pad 30 overlying holes 60 and 80, respectively. The holes 60 and 80 may be formed on opposite sides of platen 24, e.g., about 180° apart. Similarly, windows 62 and 82 may be formed on opposite sides of polishing pad 30 over holes 60 and 80, respectively. Transparent windows 62 and 82 may be constructed as described in U.S. patent application Ser. No. 08/689,930, entitled METHOD OF FORMING A TRANSPARENT WINDOW IN A POLISHING PAD FOR A CHEMICAL MECHANICAL POLISHING APPARATUS by Manoocher Birang, et al., filed Aug. 26, 1996, and assigned to the assignee of the present invention, the entire disclosure of which is incorporated herein by reference. Holes 60, 80 and transparent windows 62, 82, are positioned such that they each alternately provide a view of substrate 10 during a portion of the platen's rotation, regardless of the translational position of carrier head 50.

Two optical systems 64 and 84 for interferometric measurement of the substrate thickness and polishing rate are located below platen 24 beneath windows 62 and 82, respectively. The optical systems may be secured to platen 24 so that they rotate with the platen and thereby maintain a fixed position relative to the windows. The first optical system is an "off-axis" system in which light impinges the substrate at a non-normal incidence angel. Optical system 64 includes a first light source 66 and a first sensor 68, such as a photodetector. The first light source 66 generates a first light beam 70 which propagates through transparent window 62, and any slurry 36 on the pad (see FIG. 4) to impinge the exposed surface of substrate 10. The light beam 70 is projected from light source 66 at an angle $\alpha_1$ from an axis normal to the surface of substrate 10. The propagation angle $\alpha_1$ may be between 0° and 45°, e.g., about 16°. In one implementation, light source 66 is a laser that generates a laser beam with a wavelength of about 600–1500 nanometers (nm), e.g., 670 nm. If hole 60 and window 62 are elongated, a beam expander (not illustrated) may be positioned in the path of light beam 70 to expand the light beam along the elongated axis of the window.

The second optical system 84 may also be an "off-axis" optical system with a second light source 86 and a second sensor 88. The second light source 86 generates a second light beam 90 which has a second wavelength that is different from the first wavelength of first light beam 70. Specifically, the wavelength of the second light beam 90 may be shorter than the wavelength of the first light beam 70. In one implementation, second light source 86 is a laser that generates a light beam with a wavelength of about 300–500 nm or 300–600 nm, e.g., 470 nm. The light beam 90 is projected from light source 86 at an angle of $\alpha_2$ from an axis normal to the exposed surface of the substrate. The projection angle $\alpha_2$ may be between 0° and 45°, e.g., about 16°. If the hole 80 and window 82 are elongated, another beam expander (not illustrated) may be positioned in the path of light beam 90 to expand the light beam along the elongated axis of the window.

Light sources 66 and 86 may operate continuously. Alternately, light source 66 may be activated to generate light beam 70 when window 62 is generally adjacent substrate 10, and light source 86 may be activated to generate light beam 90 when window 82 is generally adjacent substrate 10.

The CMP apparatus 20 may include a position sensor 160, to sense when windows 62 and 82 are near the substrate. Since platen 24 rotates during the CMP process, platen windows 62 and 82 will only have a view of substrate 10 during part of the rotation of platen 24. To prevent spurious reflections from the slurry or the retaining ring from interfering with the interferometric signal, the detection signals from optical systems 64, 84 may be sampled only when substrate 10 is impinged by one of light beams 70, 90. The position sensor is used to ensure that the detection signals are sampled only when substrate 10 overlies one of the windows. Any well known proximity sensor could be used, such as a Hall effect, eddy current, optical interrupter, or acoustic sensor. Specifically, position sensor 160 may include two optical interrupters 162 and 164 (e.g., LED/photodiode pairs) mounted at fixed points on the chassis of the CMP apparatus, e.g., opposite each other and 90° from carrier head 50. A position flag 166 is attached to the periphery of the platen. The point of attachment and length of flag 166, and the positions of optical interrupters 162 and 164, are selected so that the flag triggers optical interrupter 162 when window 62 sweeps beneath substrate 10, and the flag triggers optical interrupter 164 when window 82 sweeps beneath substrate 10. The output signal from detector 68 may be measured and stored while optical interrupter 162 is triggered by the flag, and the output signal from detector 88 may be measured and stored while optical interrupter 164 is triggered the flag. The use of a position sensor is also discussed in the above-mentioned U.S. patent application Ser. No. 08/689,930.

In operation, CMP apparatus 20 uses optical systems 64, 84 to determine the amount of material removed from the surface of the substrate, or to determine when the surface has become planarized. The light source 66, 86, detectors 68, 88 and sensor 160 may be connected to a general purpose programmable digital computer or processor 52. A rotary coupling 56 may provide electrical connections for power and data to and from light sources 66, 86 and detectors 68, 88. Computer 52 may be programmed to receive input signals from the optical interrupter, to store intensity measurements from the detectors, to display the intensity measurements on an output device 54, to calculate the initial thickness, polishing rate, amount removed and remaining thickness from the intensity measurements, and to detect the polishing endpoint.

Figure 4:
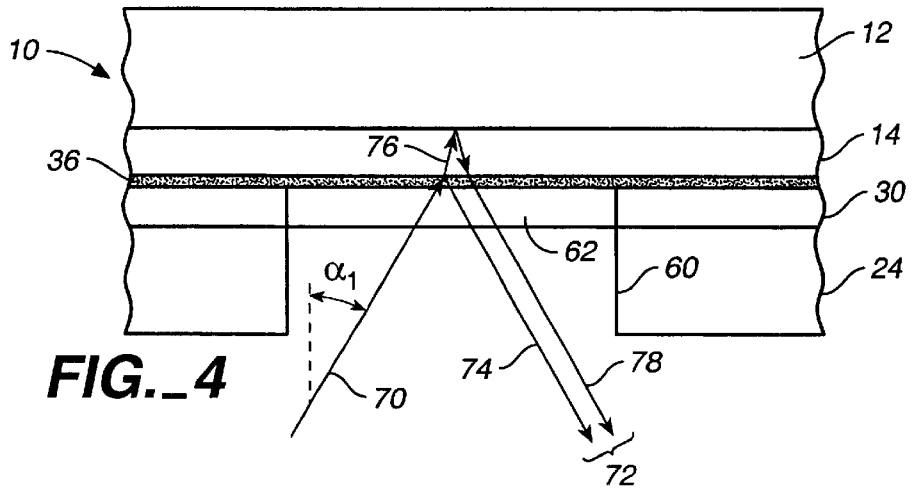
FIG. 4 is a schematic diagram illustrating a light beam from the first optical system impinging a substrate at an angle and reflecting from two surfaces of the substrate.

Referring to FIG. 4, substrate 10 includes a wafer 12, such as a silicon wafer, and an overlying thin film structure 14. The thin film structure includes a transparent or partially transparent outer layer, such as a dielectric layer, e.g., an oxide layer, and may also include one or more underlying layers, which may be transparent, partially transparent, or reflective.

At the first optical system 64, the portion of light 20 beam 70 which impinges on substrate 10 will be partially reflected at a first surface, i.e., the surface of the outer layer, of thin film structure 14 to form a first reflected beam 74. However, a portion of the light will also be transmitted through thin film structure 14 to form a transmitted beam 76. At least some of the light from transmitted beam 76 will be reflected by one or more underlying surfaces, e.g., by one or more of the surfaces of the underlying layers in structure 14 and/or by the surface of wafer 12, to form a second reflected beam 78. The first and second reflected beams 74, 78 interfere with each other constructively or destructively depending on their phase relationship, to form a resultant return beam 72 (see also FIG. 2). The phase relationship of the reflected beams is primarily a function of the index of refraction and thickness of the layer or layers in thin film structure 14, the wavelength of light beam 70, and the angle of incidence $\alpha_1$.

Returning to FIG. 2, return beam 72 propagates back through slurry 36 and transparent window 62 to detector 68. If the reflected beams 74, 78 are in phase with each other, they cause a maxima ($I_{max1}$) on detector 68. On the other hand, if reflected beams 74, 78 are out of phase, they cause a minima ($I_{min1}$) on detector 68. Other phase relationships will result in an interference signal between the maxima and minima being seen by detector 68. The result is a signal output from detector 68 that varies with the thickness of the layer or layers in structure 14.

Because the thickness of the layer or layers in structure 14 change with time as the substrate is polished, the signal output from detector 68 also varies over time. The time varying output of detector 68 may be referred to as an in-situ reflectance measurement trace (or "reflectance trace"). This reflectance trace may be used for a variety of purposes, including detecting a polishing endpoint, characterizing the CMP process, and sensing whether the CMP apparatus is operating properly.

Figure 5:
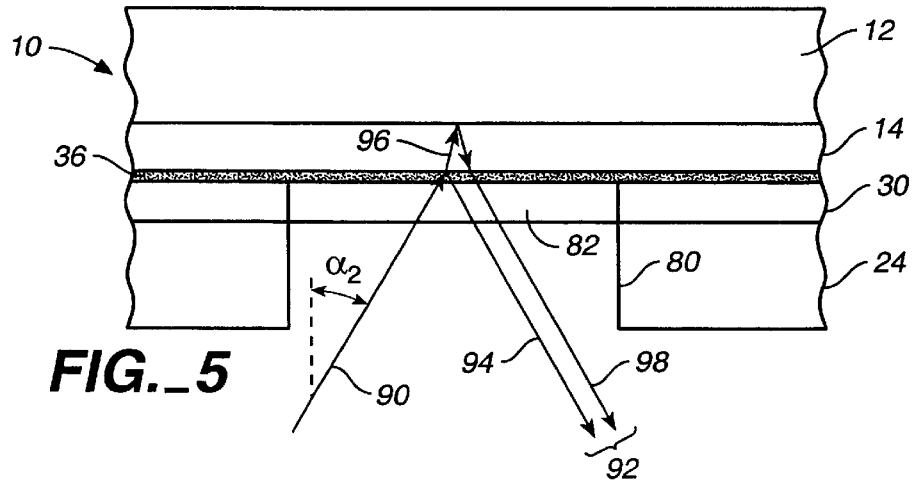
FIG. 5 is a schematic diagram illustrating a light beam from the second optical system impinging a substrate at an angle and reflecting from two surfaces of the substrate.

Referring to FIG. 5, in the second optical system 84, a first portion of light beam 90 will be partially reflected by the surface layer of thin film structure 14 to form a first reflected beam 94. A second portion of the light beam will be transmitted through thin film structure 14 to form a transmitted beam 96. At least some of the light from transmitted beam 96 is reflected, e.g., by one of the underlying layers in structure 14 or by wafer 12, to form a second reflected beam 98. The first and second reflected beams 94, 98 interfere with each other constructively or destructively depending on their phase relationship, to form a resultant return beam 92 (see also FIG. 2). The phase relationship of the reflected beams is a function of the index of refraction and thickness of the layer or layers in structure 14, the wavelength of light beam 90, and the angle of incidence $\alpha_2$.

The resultant return beam 92 propagates back through slurry 36 and transparent window 82 to detector 88. The time-varying phase relationship between reflected beams 94, 98 will create a time-varying interference pattern of minima ($I_{min2}$) and maxima ($I_{max2}$) at detector 88 related to the time-varying thickness of the layer or layers in thin film structure 14. Thus, the signal output from detector 88 also varies with the thickness of the layer or layers in thin film structure 14 to create a second reflectance trace. Because the optical systems employ light beams that have different wavelengths, the time varying reflectance trace of each optical system will have a different pattern.

When a blank substrate, i.e., a substrate in which the layer or layers in thin film structure 14 are unpatterned, is being polished, the data signal output by detectors 68, are cyclical due to interference between the portion of the light beam reflected from the surface layer of the thin film structure and the portion of the light beam reflected from the underlying layer or layers of thin film structure 14 or from wafer 12. Accordingly, the thickness of material removed during the CMP process can be determined by counting the cycles (or fractions of cycles) of the data signal, computing how much material would be removed per cycle (see Equation 5 below), and computing the product of the cycle count and the thickness removed per cycle. This number can be compared with a desired thickness to be removed and the process controlled based on the comparison. The calculation of the amount of material removed from the substrate is also discussed in the above-mentioned U.S. patent application Ser. No. 08/689,930.

Figure 6:
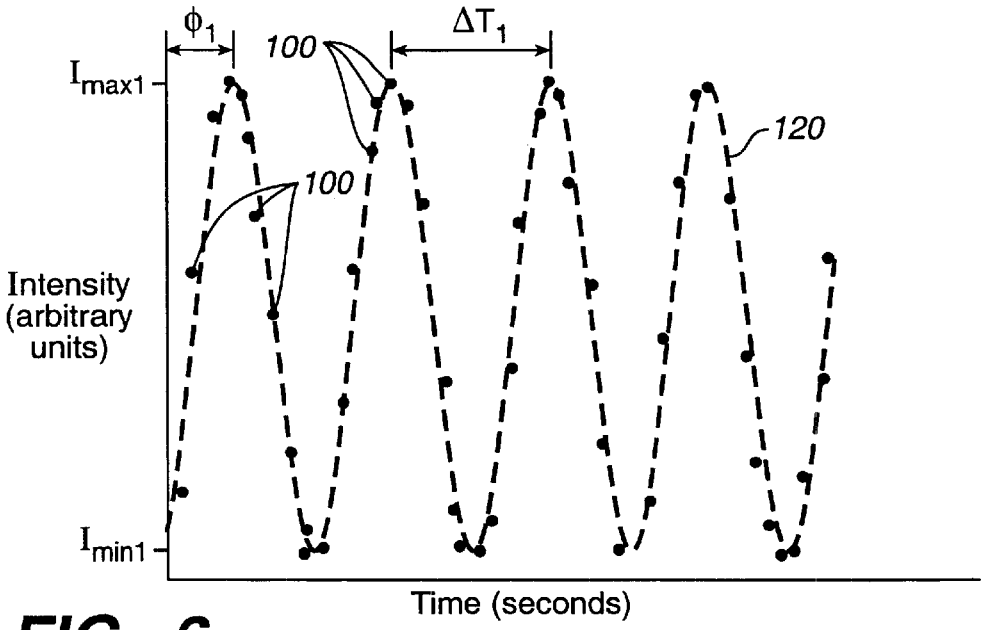
FIG. 6 is a graph of a hypothetical reflective trace that could be generated by the first optical system in the CMP apparatus of FIG. 2.
Figure 7:
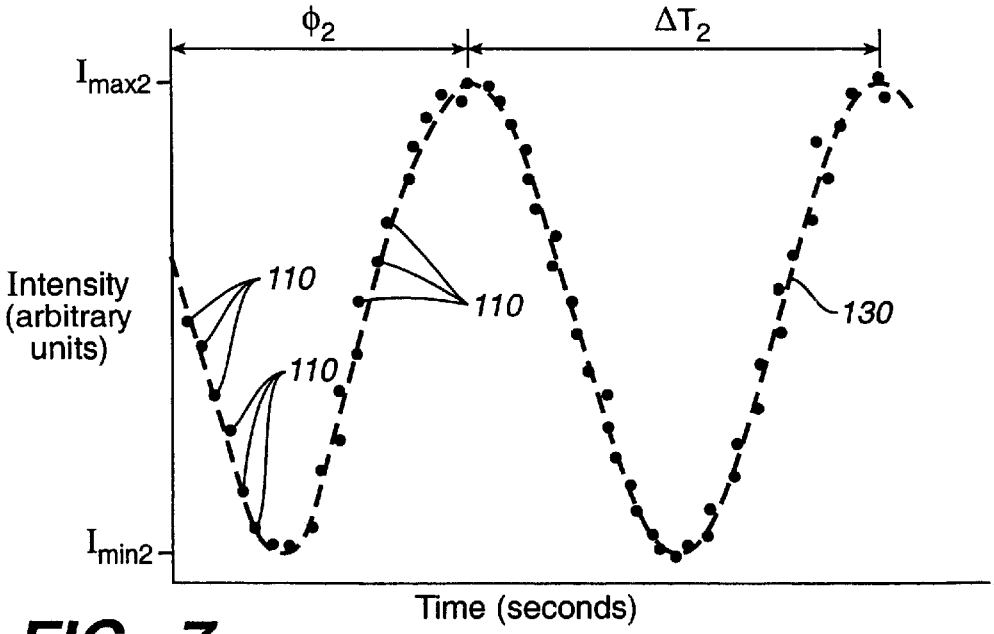
FIG. 7 is a graph of a hypothetical reflectance trace that could be generated by the second optical system in the CMP apparatus of FIG. 2.

Referring to FIGS. 6 and 7, assuming that substrate 10 is a "blank" substrate, the resulting reflectance traces 100 and 110 (shown by the dots) from optical systems 64 and 84, respectively, will be a series of intensity measurements that generally follow sinusoidal curves. The CMP apparatus uses reflectance traces 100 and 110 to determine the amount of material removed from the surface of a substrate.

Computer 52 uses the intensity measurements from detectors 68 and 88 to generate a model function (shown by phantom lines 120 and 130) for each reflectance trace 100 and 110. Preferably, each model function is a sinusoidal wave. Specifically, the model function $I_1$ ($T_{measure}$) for reflectance trace 100 may be the following:

$$I_1(T_{measure}) = k_1 \cdot \frac{I_{max1} + I_{min1}}{2} + \frac{I_{max1} - I_{min1}}{2} \cdot \cos\left(\frac{\phi_1 + T_{measure}}{\Delta T_1} 2\pi\right) \quad (1)$$

where $I_{max1}$ and $I_{min1}$ are the maximum and minimum amplitudes of the sine wave, $\phi_1$ is a phase difference of model function 120, $\Delta T_1$ is the peak-to-peak period of the sine wave of model function 120, $T_{measure}$ is the measurement time, and $k_1$ is an amplitude adjustment coefficient. The maximum amplitude $I_{max1}$ and the minimum amplitude $I_{min1}$ may be determined by selecting the maximum and minimum intensity measurements from reflectance trace 100. The model function 120 is fit to the observed intensity measurements of reflectivity trace 100 by a fitting process, e.g., by a conventional least square fit. The phase difference $\phi_1$ and peak-to-peak period $\Delta T_1$, are the fitting coefficients to be optimized in Equation 1. The amplitude adjustment coefficient $k_1$ may be set by the user to improve the fitting process, and may have a value of about 0.9.

Similarly, the model function $I_2$ ($T_{measure}$) for reflectance trace 110 may be the following:

$$I_2(T_{measure}) = k_2 \cdot \frac{I_{max2} + I_{min2}}{2} + \frac{I_{max2} - I_{min2}}{2} \cdot \cos\left(\frac{\phi_2 + T_{measure}}{\Delta T_2} 2\pi\right) \quad (2)$$

where $I_{max2}$ and $I_{min2}$ are the maximum and minimum amplitudes of the sine wave, $\phi_2$ is a phase difference of model function 130, $\Delta T_2$ is the peak-to-peak period of the sine wave of model function 130, $T_{measure}$ is the measurement time, and $k_2$ is an amplitude adjustment coefficient. The maximum amplitude $I_{max2}$ and the minimum amplitude $I_{min2}$ may be determined by selecting the maximum and minimum intensity measurements from reflectivity trace 110. The model function 130 is fit to the observed intensity measurements of reflectivity trace 110 by a fitting process, e.g., by a conventional least square fit. The phase difference $\phi_2$ and peak-to-peak period $\Delta T_2$ are the fitting coefficients to be optimized in Equation 2. The amplitude adjustment coefficient $k_2$ may be set by the user to improve the fitting process, and may have a value of about 0.9.

Since the actual polishing rate can change during the polishing process, the polishing variables which are used to calculate the estimated polishing rate, such as the peak-to-peak period, should be periodically recalculated. For example, the peak-to-peak periods $\Delta T_1$ and $\Delta T_2$ may be recalculated based on the intensity measurements for each cycle. The peak-to-peak periods may be calculated from intensity measurements in overlapping time periods. For example, a first peak-to-peak period may be calculated from the intensity measurement in the first 60% of the polishing run, and a second peak-to-peak period may be calculated from the intensity measurements in the last 60% of the polishing run. The phase differences $\phi_1$ and $\phi_2$ are typically calculated only for the first cycle.

Once the fitting coefficients have been determined, the initial thickness of the thin film layer, the current polishing rate, the amount of material removed, and the remaining thin film layer thickness may be calculated. The current polishing rate p may be calculated from the following equation:

$$P = \frac{\lambda}{\Delta T \cdot 2n_{layer}\cos\alpha'} \quad (3)$$

where $\lambda$ is the wavelength of the laser beam, $n_{layer}$ is the index of refraction of the thin film layer, and $\alpha'$ is the angle of laser beam through the thin film layer, and $\Delta T$ is the most recently calculated peak-to-peak period. The angle $\alpha'$ may be determined from Snell's law, $n_{layer} \sin \alpha' = n_{air} \sin \alpha$, where $n_{layer}$ is the index of refraction of the layer in structure 14, $n_{air}$ is the index of refraction of air, and $\alpha$ ($\alpha_1$ or $\alpha_2$) is the off-vertical angle of light beam 70 or 90. The polishing rate may be calculated from each reflectance trace and compared.

The amount of material removed, $D_{removed}$, may be calculated either from the polishing rate, i.e., $$D_{removed} = P \cdot T_{measure} \quad (4)$$

or by counting the number or fractional number of peaks in one of the reflectivity trace, and multiplying the number of peaks by the peak-to-peak thickness $\Delta D$ for that reflective trace (i.e., $\Delta D_1$ for reflectance trace 100 and $\Delta D_2$ for reflectance trace 110), where $$\Delta D = \frac{\lambda}{2n_{layer}\cos\alpha'} \quad (5)$$

The initial thickness $D_{initial}$ of the thin film layer may be calculated from the phase differences $\phi_1$ and $\phi_2$. The initial thickness $D_{initial}$ will be equal to:

$$D_{initial} = \left(\frac{\phi_1}{\Delta T_1} + M\right) \cdot \frac{\lambda_1}{2n_{layer}\cos\alpha'_1} \quad (6)$$

and equal to $$D_{initial} = \left(\frac{\phi_2}{\Delta T_2} + N\right) \cdot \frac{\lambda_2}{2n_{layer}\cos\alpha'_2} \quad (7)$$

where M and N are equal to or close to integer values. Consequently, $$M = \left(\frac{\phi_2}{\Delta T_2} + N\right) \cdot \frac{\cos\alpha'_1}{\cos\alpha'_2} \cdot \frac{\lambda_2}{\lambda_1} - \frac{\phi_1}{\Delta T_1} \quad (8)$$

For an actual substrate, the manufacturer will know that the layers in structure 14 will not be fabricated with a thickness greater than some benchmark value. Therefore, the initial thickness $D_{initial}$ should be less than a maximum thickness $D_{max}$, e.g., 25000 Å for a layer of silicon oxide. The maximum value, $N_{max}$, of N can be calculated from the maximum thickness $D_{max}$ and the peak-to-peak thickness $\Delta D_2$ as follows:

$$N_{\max} = \frac{D_{\max}}{\Delta D_2} = \frac{D_{\max} \cdot 2n_{layer}\cos\alpha'_2}{\lambda_2} \quad (9)$$

Consequently, the value of M may be calculated for each integer value of N=1, 2, 3, . . . , $N_{max}$. The value of M that is closest to an integer value may be selected, as this represents the mostly likely solution to Equation 6, and thus the most likely actual thickness. Then the initial thickness may be calculated from Equation 6 or 7.

Of course, a value of N could be calculated for each integer value of M, in which case the maximum value, $M_{max}$, of M would be equal to $D_{max}/\Delta D_1$. However, it may be preferable to calculate for each integer value of the variable that is associated with the longer wavelength, as this will require fewer computations of the other integer variable.

Figure 8A:
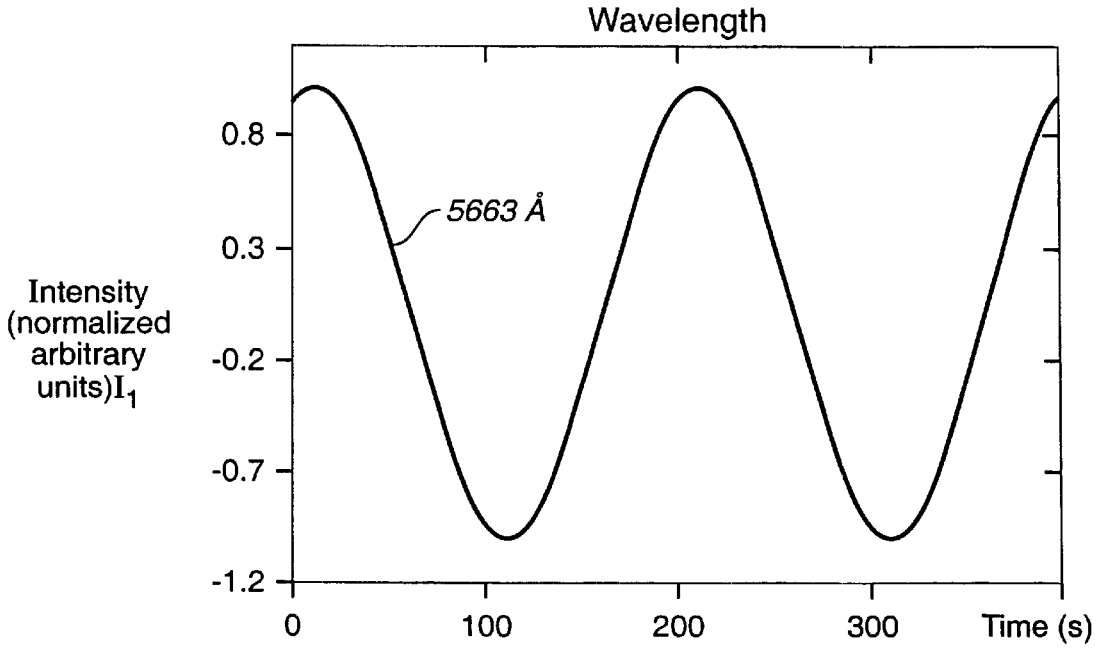
FIGS. 8A and 8B are graphs of two hypothetical model functions.
Figure 8B:
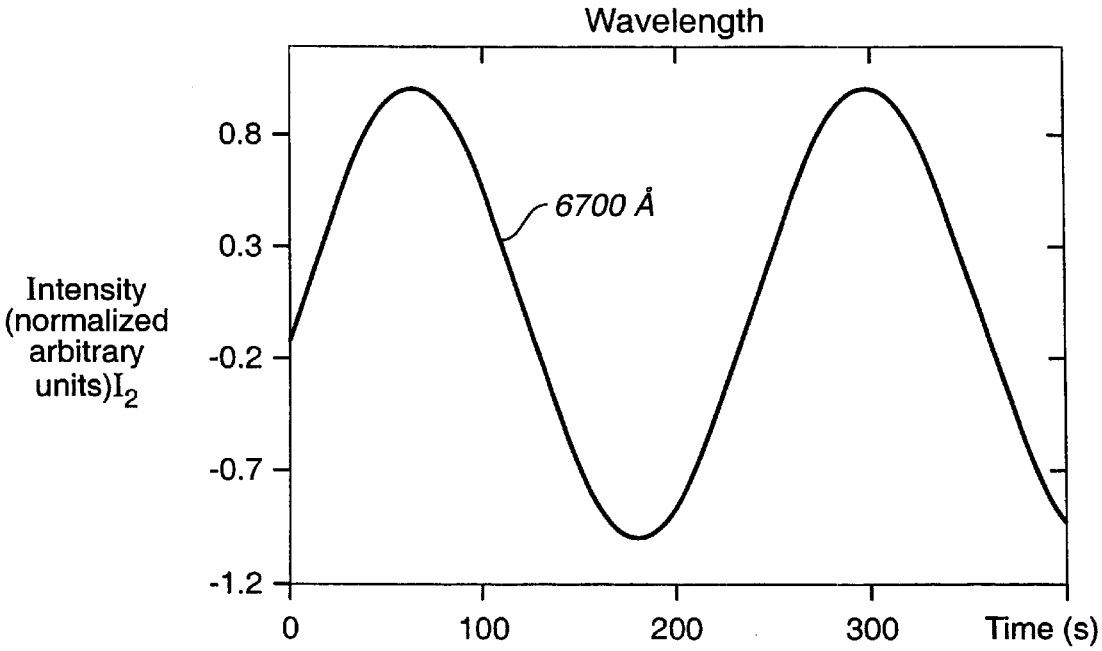

Referring to FIGS. 8A and 8B, two hypothetical model functions 140 and 150 were generated to represent the polishing of a silicon oxide ($SiO_2$) surface layer on a silicon wafer.

The fitting coefficients that represent the hypothetical model functions 140 and 150 are given in Table 1.

TABLE 1

| | | |
|---|---|---|
| phase offset | $\phi_1$ = 12.5 s | $\phi_2$ = 65.5 s |
| peak-to-peak period | $\Delta T_1$ = 197.5 s | $\Delta T_2$ = 233.5 s |

These fitting coefficients were calculated for polishing rate of 10 Å/sec and utilizing the polishing parameters in Table 2.

TABLE 2

| | 1st optical system | 2nd optical system |
|---|---|---|
| material | silicon oxide | silicon oxide |
| initial thickness | 10000Å | 10000Å |
| polishing rate | 10Å/sec | 10Å/sec |
| refractive index | $n_{layer}$ = 1.46 | $n_{layer}$ = 1.46 |
| wavelength | $\lambda_1$ = 5663 Å | $\lambda_2$ = 6700 Å |
| incidence angle in air | $\alpha_1$ = 16° | $\alpha_2$ = 16° |
| angle in layer | $\alpha_1'$ = 10.88° | $\alpha_2'$ = 10.88° |
| peak-to-peak thickness | $\Delta D_1$ = 1970 Å | $\Delta D_2$ = 2336 Å |

Using Equation 8, the M-values can be calculated for integer values of N, as shown in Table 3.

TABLE 3

| N | M | integer of M | thickness for N | thickness for M | thickness difference |
|---|---|---|---|---|---|
| 0 | 0.27 | 0 | 655 | 125 | 530 |
| 1 | 1.45 | 1 | 2992 | 2100 | 892 |
| 2 | 2.63 | 3 | 5329 | 6050 | −721 |
| 3 | 3.82 | 4 | 7665 | 8025 | −360 |
| 4 | 5.00 | 5 | 10002 | 9999 | 2 |
| 5 | 6.18 | 6 | 12338 | 11974 | 364 |
| 6 | 7.37 | 7 | 14675 | 13949 | 725 |
| 7 | 8.55 | 9 | 17011 | 17899 | −888 |
| 8 | 9.73 | 10 | 19348 | 19874 | −526 |
| 9 | 10.92 | 11 | 21684 | 21849 | −165 |
| 10 | 12.10 | 12 | 24021 | 23824 | 197 |
| 11 | 13.28 | 13 | 26357 | 25799 | 559 |
| 12 | 14.47 | 14 | 28694 | 27774 | 920 |
| 13 | 15.65 | 16 | 31030 | 31723 | −693 |
| 14 | 16.83 | 17 | 33367 | 33698 | −331 |
| 15 | 18.02 | 18 | 35704 | 35673 | 30 |
| 16 | 19.20 | 19 | 38040 | 37648 | 392 |
| 17 | 20.38 | 20 | 40377 | 39623 | 754 |
| 18 | 21.56 | 22 | 42713 | 43573 | −860 |

As shown, the best fit, i.e., the choice of N that provides a value of M that is closest to an integer, is for N=4 and M=5, with a resulting initial thickness of approximately 10000 Å, which is acceptable because ti is less than the maximum thickness. The next best fit is N=15 and M=18, with a resulting initial thickness of approximately 35700 Å. Since this thickness is greater than the expected maximum initial thickness $D_{max}$ of 25000 Å, this solution may be rejected.

Thus, the invention provides a method of determining the initial thickness of a surface layer on a substrate during a CMP process. From this initial thickness value, the current thickness D(t) can be calculated as follows:

$$D(t)=D_{initial}-D_{removed}(t) \tag{12}$$

As a normal thickness for a deposited layer typically is between 10001 Å and 20000 Å, the initial as well as the current thickness can be calculated. The only prerequisite to estimate the actual thickness is to have sufficient intensity measurements to accurately calculate the peak-to-peak periods and phase offsets. In general, this requires at least a minima and a maxima for each of the wavelengths. However, the more minima and maxima in the reflective trace, and the more intensity measurements, the more accurate the calculation of the actual thickness will be.

Some combinations of wavelengths may be inappropriate for in-situ calculations, for example, where one wavelength is a multiple of the other wavelength. A good combination of wavelengths will result in an "odd" relationship, i.e., the ratio of $\lambda_1/\lambda_2$ should not be substantially equal to a ratio of small integers. Where the ratio of $\lambda_1/\lambda_2$ is substantially equal to a ratio of small integers, there may be multiple integer solutions for N and M in Equation 8. In short, the wavelengths $\lambda_1$ and $\lambda_2$ should be selected so that there is only one solution to Equation 8 that provides substantially integer values to both N and M within the maximum initial thickness.

In addition, preferred combinations of wavelengths should be capable of operating in a variety of dielectric layers, such as $SiO_2$, $Si_3N_4$, and the like. Longer wavelengths may be preferable when thick layers have to be polished, as less peaks will appear. Short wavelengths are more appropriate when only minimal polishing is performed.

The two optical systems 64, 84 can be configured with light sources having different wavelengths and the same propagation angle. Also, light sources 66, 86 could have different wavelengths and different respective propagation angles an $\alpha_1$, $\alpha_2$. It is also possible for light sources 66, 86 to have the same wavelength and different respective propagation angles $\alpha_1$, $\alpha_2$.

The available wavelengths may be limited by the types of lasers, light emitting diodes (LEDs), or other light sources that can be incorporated into an optical system for a polishing platen at a reasonable cost. In some situations, it may impractical to use light sources with an optimal wavelength relationship. The system may still be optimized, particularly when two off-axis optical systems are used, by using different angles of incidence for the light beams from the two sources. This can be seen by from the expression for the peak-to-peak thickness ΔD, $\Delta D=\lambda/(2n^*\cos\alpha')$, where λ is the wavelength of the light source, n is the index of refraction of the dielectric layer, and α' is the propagation angle of the light through the layer in the thin film structure. Thus, an effective wavelength $\lambda_{eff}$ can be defined as $\lambda/\cos\alpha'$, and it is the effective wavelength $\lambda_{eff}$ of each light source that is important to consider when optimizing the wavelengths of the different light sources. However, one effective wavelength should not be an integer multiple of the other effective wavelength, and the ratio of $\lambda_{eff1}/\lambda_{eff2}$ should not be substantially equal to a ratio of small integers.

Figure 10:
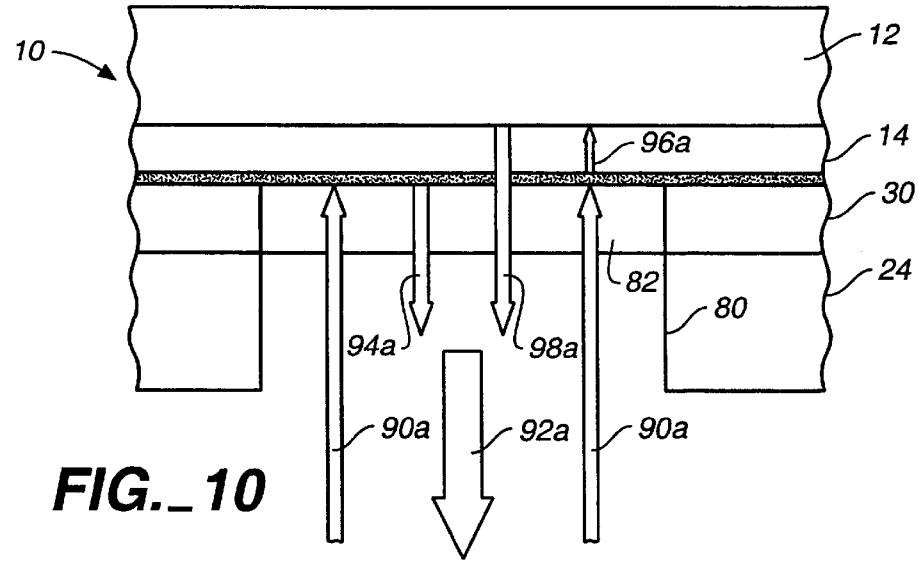
FIG. 10 is a schematic diagram illustrating a light beam impinging a substrate at a normal incidence and reflecting from two surfaces of the substrate.
Figure 9:
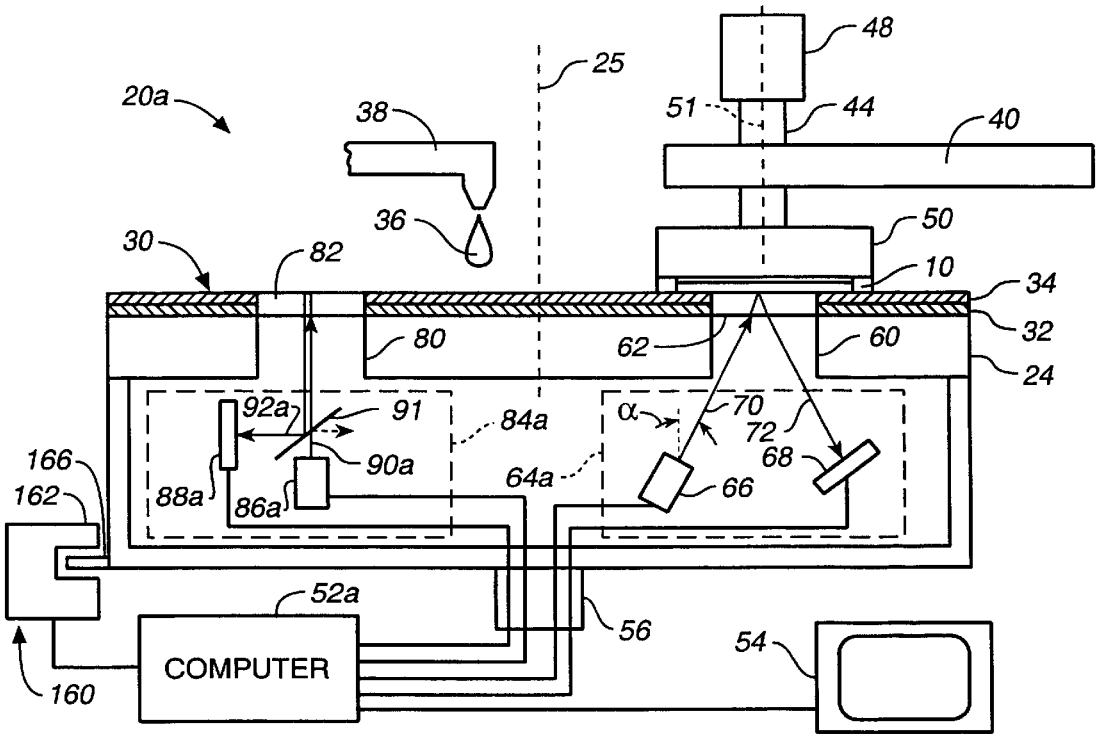
FIG. 9 is a schematic cross-sectional view of a CMP apparatus having a first, off-axis optical system and a second, normal-axis optical system.

Referring to FIGS. 9 and 10, CMP apparatus 20*a* has a platen 24 configured similarly to that described above with reference to FIGS. 1 and 2. CMP apparatus 20*a*, however, includes an off-axis optical system 64 and a normal-axis optical system 84*a*. The normal axis optical system 84*a* includes a light source 86*a*, a transreflective surface 91, such as a beam splitter, and a detector 88*a*. A portion of light beam 90*a* passes through beam splitter 91, and propagates through transparent window 82*a* and slurry 36*a* to impinge substrate 10 at normal incidence. In this implementation, the aperture 80*a* in platen 24 can be smaller because light beam 90*a* passes through the aperture and returns along the same path.

Figure 11:
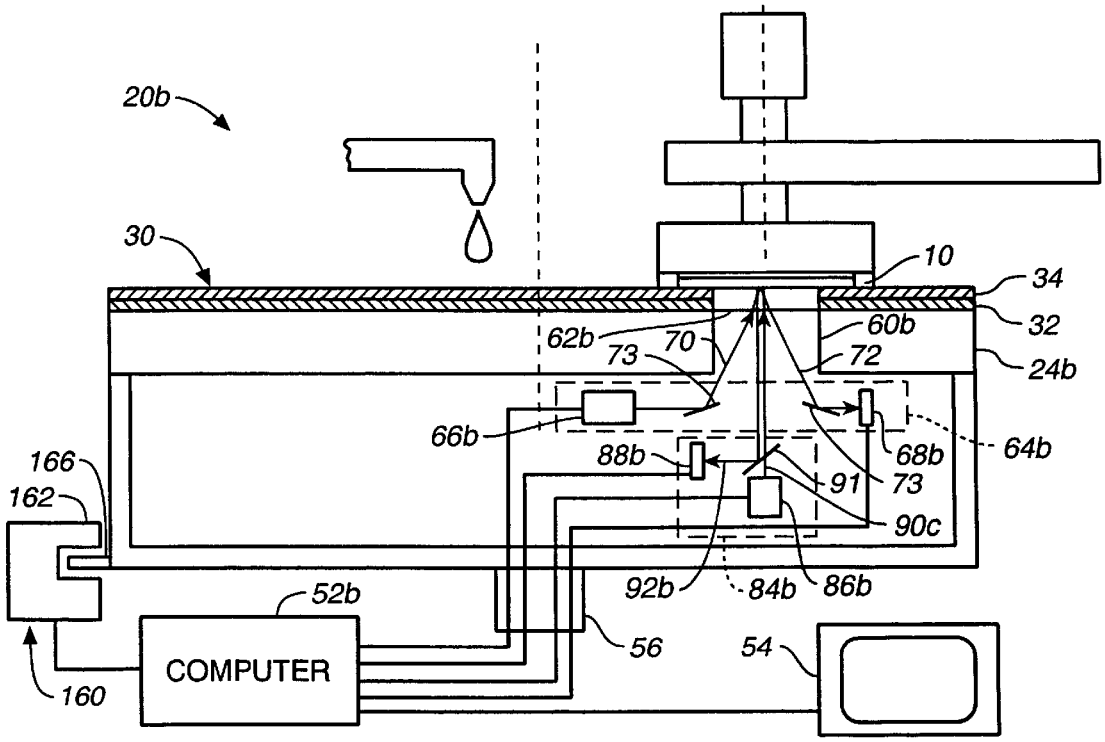
FIG. 11 is a schematic cross-sectional view of a CMP apparatus having a two optical systems and one window in the polishing pad.

Referring now to FIG. 11, in another implementation, CMP apparatus 20*b* has a single opening 60*b* in platen 24*b* and a single window 62*b* in polishing pad 30*b*. An off-axis optical system 64*b* and a normal-axis optical system 84*b* each direct respective light beams through the same window 62*b*. The light beams 70*b* and 90*b* may be directed at the same spot on substrate 10. This implementation needs only a single optical interrupter 162. Mirrors 93 may be used to adjust the incidence angle of the laser on the substrate.

Figure 12:
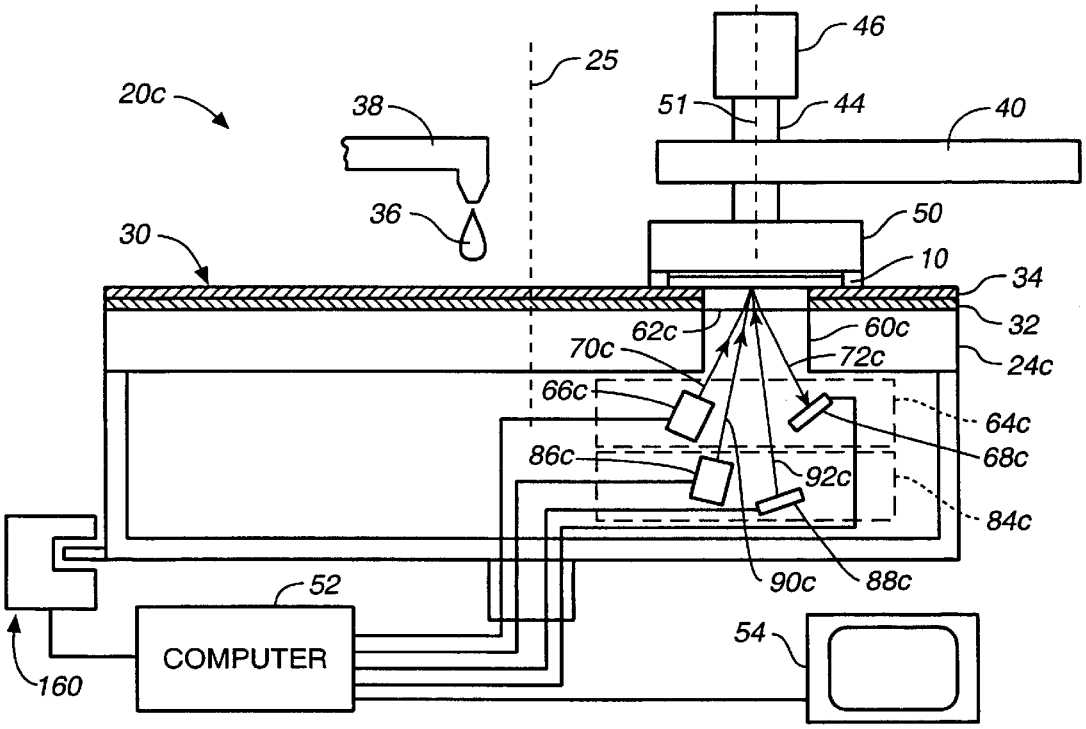
FIG. 12 is a schematic cross-sectional view of a CMP apparatus having two off-axis optical systems and one window in the polishing pad.

Referring now to FIG. 12, in yet another implementation, CMP apparatus 20*c* has two off-axis optical systems 64*c* and 84*c* that direct light beams 70*c* and 90*c* at the same spot on substrate 10. Light source 66*c* and detector 68*c* of optical system 64*c* and light source 86*c* and detector 88*c* of optical system 84*c* may be arranged such that a plane defined by light beams 70*c* and 72*c* crosses a plane defined by light beams 90*c* and 92*c*. For example, optical systems 64*c*, 84*c* can be offset by about 90° from each other. This implementation also needs only a single optical interrupter 162, and permits the effective wavelength of the first light beam 70*c* to be adjusted by modifying the incidence angle.

Although the optical systems 64*c*, 84*c* are illustrated as using different propagation angles $\alpha_1$ and $\alpha_2$, the propagation angles can be the same. In addition, the light sources could be located side by side (horizontally), the light beams could reflect off a single mirror (not shown), and the return beams could impinge two areas of a single detector. This would be conducive to combining the two light sources, mirror and detector in a single optical module. Furthermore, the light beams could impinge different spots on the substrate.

Figure 13:
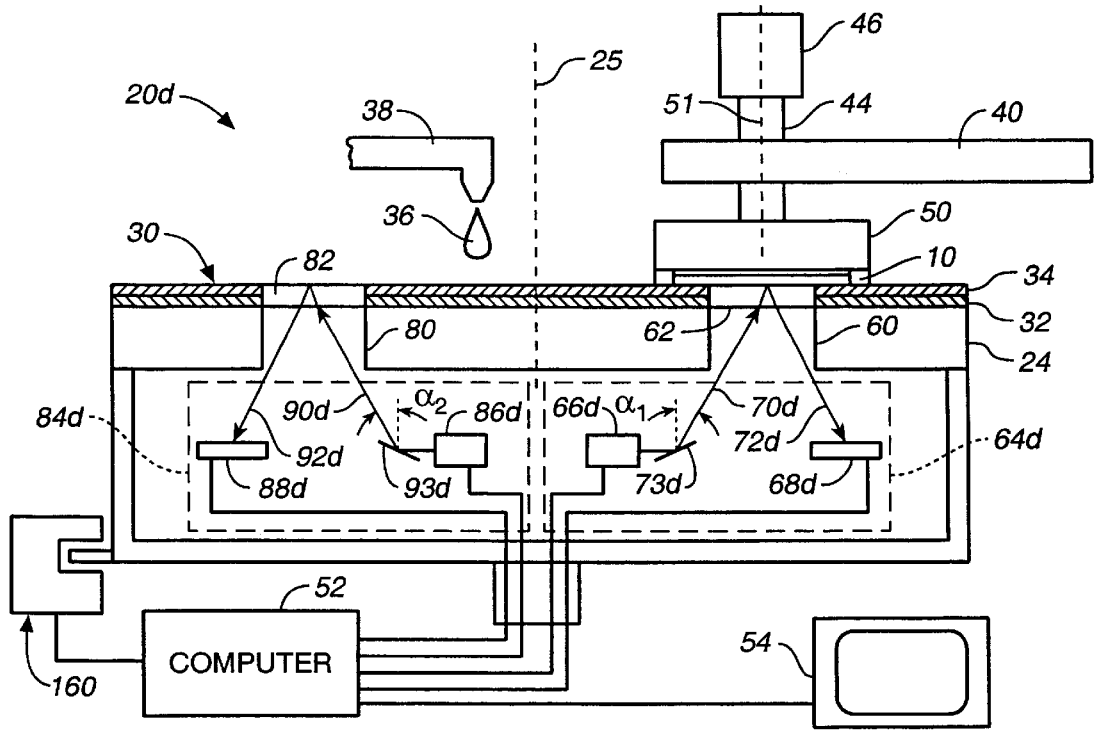
FIG. 13 is a schematic cross-sectional view of a CMP apparatus having two optical modules arranged alongside each other.

In another implementation, shown in FIG. 13, two optical systems 64*d*, 84*d* are arranged next to each other in separate modules. Optical systems 64*d*, 84*d* have respective light sources 66*d*, 86*d*, detectors 68*d*, 88*d*, and mirrors 73*d* and 93*d* to direct the light beams onto the substrate at the described propagation angles $\alpha_1$ and $\alpha_2$.

It will be understood that other combinations of optical systems and window arrangements are also within the scope of the invention, as long as the optical systems operate at different effective wavelengths. For example, different combinations of off-axis optical systems and normal-axis optical systems can be arranged to direct light beams through either the same or different windows in the platen. Additional optical components such as mirrors can be used to adjust the propagation angles of the light beams before they impinge the substrate.

Figure 14:
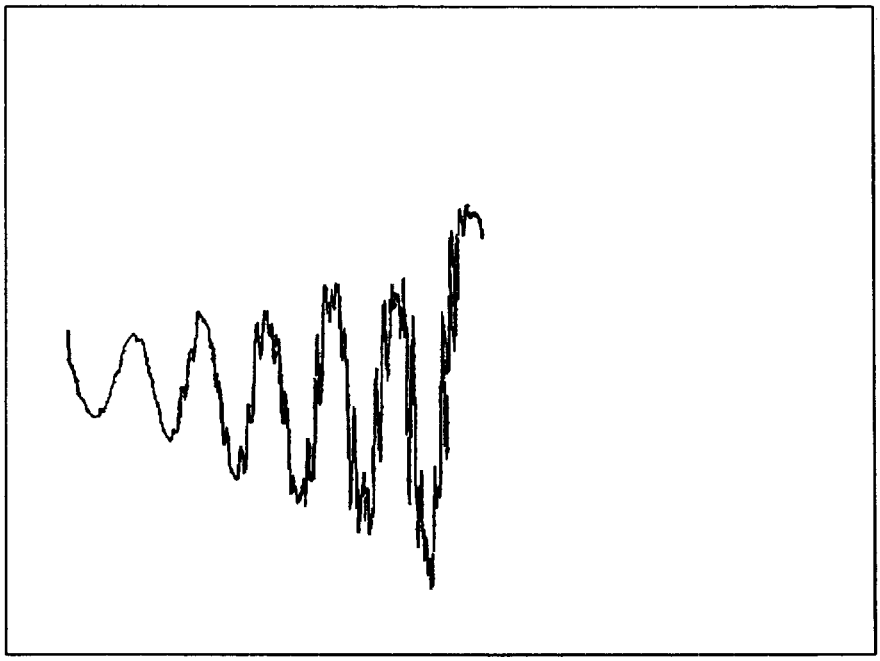
FIGS. 14 and 15 are unfiltered and filtered reflectivity traces, respectively, generated using a light emitting diode with a peak emission at 470 nm.
Figure 15:
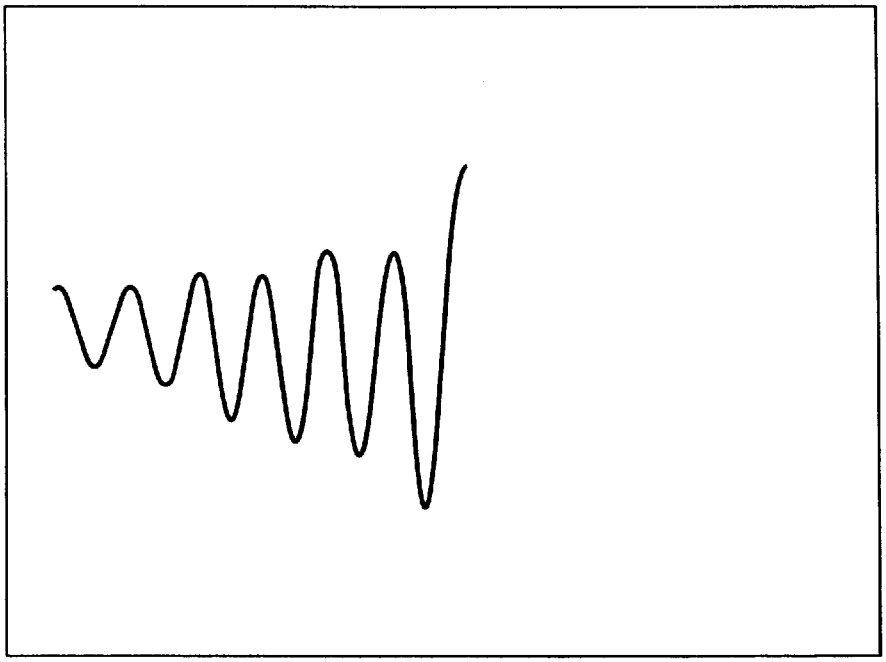

Rather than a laser, a light emitting diode (LED) can be used as a light source to generate an interference signal. The important parameter in choosing a light source is the coherence length of the light beam, which should be on the order of or greater than twice the optical path length of the light beam through of the polished layer. The optical path length OPL is given by $$OPL = \frac{2d \cdot n_{layer}}{\cos\alpha'} \tag{13}$$

where d is the thickness of the layer in structure 14. In general, the longer the coherence length, the stronger the signal will be. Similarly, the thinner the layer, the stronger the signal. Consequently, as the substrate is polished, the interference signal should become progressively stronger. As shown in FIGS. 14 and 15, the light beam generated by an LED has a sufficiently long coherence length to provide a useful reflectance trace. The traces in FIGS. 14 and 15 were generated using an LED with a peak emission at 470 nm. The reflectance traces also show that the interference signal becomes stronger as the substrate is polished. The availability of LEDs as light sources for interference measurements permits the use of shorter wavelengths (e.g., in the blue and green region of the spectrum) and thus more accurate determination of the thickness and polishing rate. The usefulness of an LED for this thickness measurement may be surprising, given that lasers are typically used for interferometric measurements and that LEDs have short coherence lengths compared to lasers.

Because the apparatus of the invention uses more than one optical system operating at more than one effective wavelength, two independent end point signals can be obtained. The two end point signals can be cross-checked when used, for example, to stop the polishing process. This provides improved reliability over systems having only one optical system. Also, if only one end point comes up within a predetermined time and if the other end point does not appear, then this can be used as a condition to stop the polishing process. In this way, a combination of both end point signals, or only one end point signal may be used as a sufficient condition to stop the polishing process.

Before the end point appears, signal traces from different optical systems may be compared with each other to detect irregular performance of one or the other signal.

When the substrate has an initially irregular surface topography to be planarized, the reflectance signal may become cyclical after the substrate surface has become significantly smoothed. In this case, an initial thickness may be calculated at an arbitrary time beginning once the reflectance signal has become sinusoidal. In addition, an endpoint (or some other process control point) may be determined by detecting a first or subsequent cycle, or by detecting some other predetermined signature of the interference signal. Thus, the thickness can be determined once an irregular surface begins to become planarized.

The invention has been described in the context of a blank wafer. However, in some cases it may be possible to measure the thickness of a layer overlying a patterned structure by filtering the data signal. This filtering process is also discussed in the above-mentioned U.S. patent application Ser. No. 08/689,930.

In addition, although the substrate has been described in the context of a silicon wafer with a single oxide layer, the interference process would also work with other substrates and other layers, and with multiple layers in the thin film structure. The key is that the surface of the thin film structure partially reflects and partially transmits, and the underlying layer or layers in the thin film structure or the wafer at least partially reflect, the impinging beam.

Figure 16:
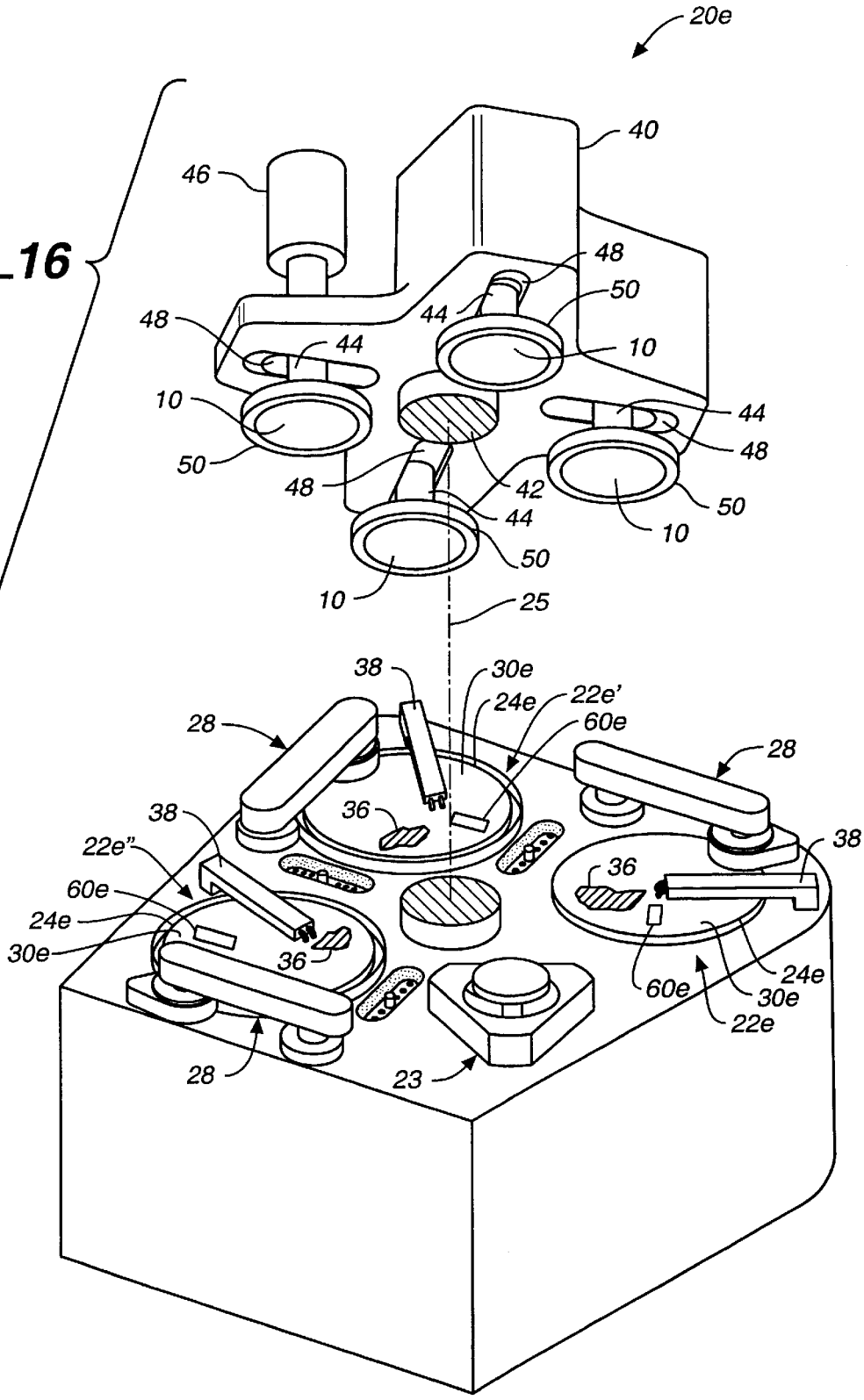
FIG. 16 is a schematic perspective view of a CMP apparatus according to the present invention.
Figure 17:
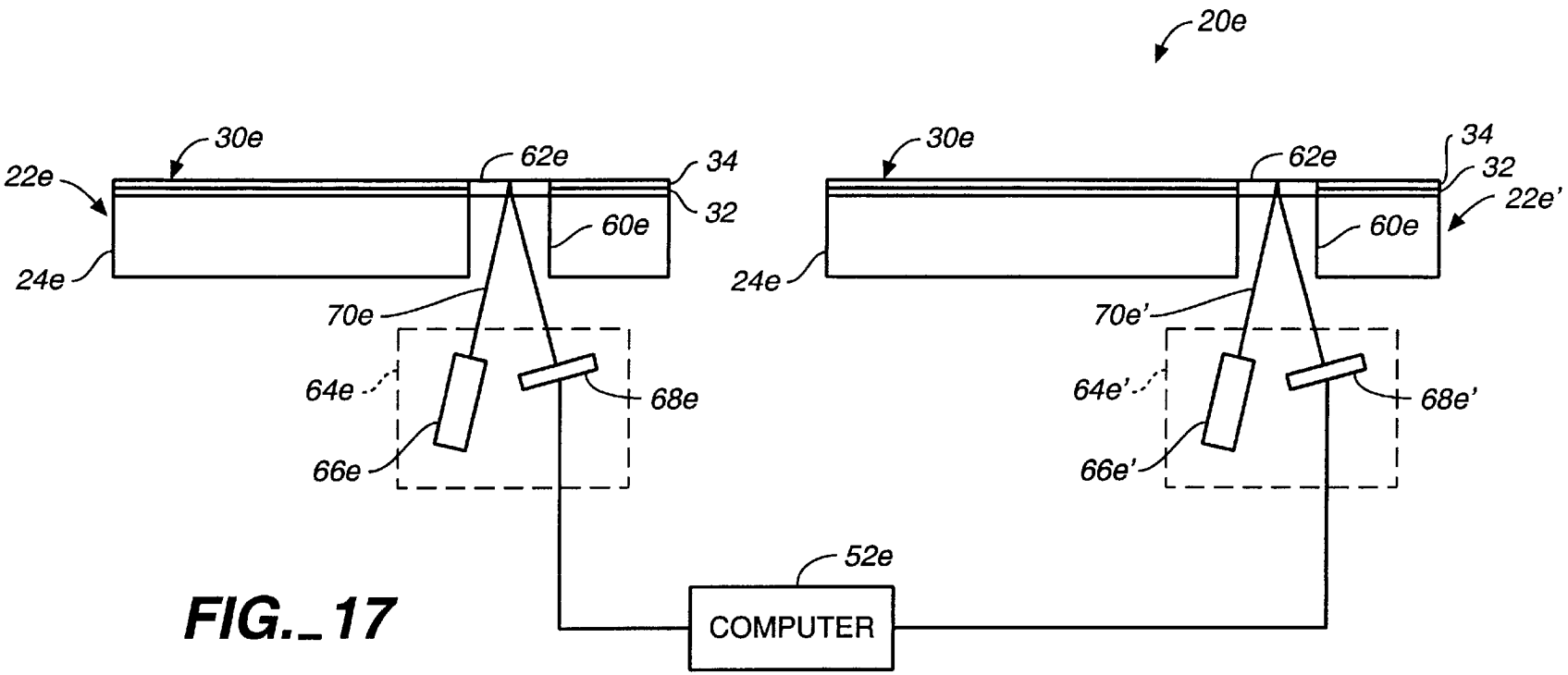
FIG. 17 is a schematic side view of two polishing stations from the CMP apparatus of FIG. 16.

Referring to FIGS. 16 and 17, in another embodiment, each polishing station in CMP apparatus 20*e* includes only a single optical system. Specifically, CMP apparatus 20*e* includes a first polishing station 22*e* with a first optical system 64*e* and a second polishing station 22*e*' with a second optical system 64*e*'. Optical systems 64*e*, 64*e*' include light sources 66*e*, 66*e*', and detectors 68*e*, 68*e*', respectively. When the substrate is positioned at the first polishing station, light source 66e directs a light beam through a hole 60*e* in platen 24*e* and a window 62*e* in polishing pad 30*e* to impinge the substrate. Similarly, once the substrate is moved to the second polishing station, light source 66*e*' directs a light beam through a hole 60*e*' in platen 24*e*' and a window 62*e*' in polishing pad 30*e*' to impinge the substrate. At each station, the associated detector measures the light reflected from the substrate to provide an interference signal, which can be used to determine a polishing endpoint, as discussed in above-mentioned U.S. application Ser. No. 08/689,930. The detectors 68*e*, 68*e*' at the two polishing stations can be connected to the same computer 52*e*, or to different computers, which will process the interference signals to detect the polishing endpoint.

Although optical systems 64*e*, 64*e*' are constructed similarly, they operate at different effective wavelengths. Specifically, the effective wavelength of light beam 70*e* in first optical system 64*e* should be larger than the effective wavelength of light beam 70*e*' in second optical system 64*e*'. This may be accomplished by using light sources with different wavelengths. For example, light source 66*e* may generate a light beam in the infrared spectrum, e.g., about 800–2000 nm, whereas light source 66*e*' may generate a light beam within the visible spectrum, e.g., about 300–700 nm. In particular, the first light beam may have a wavelength of about 1300 nm or 1550 nm, and the second light beam may have a wavelength of about 400 nm or 670 nm. The effective wavelengths of the light beams may also be adjusting by changing the incidence angles of the light beams.

In operation, a substrate (which may be either a blank substrate or a patterned device substrate) is transported to the first platen and polished until a first endpoint is detected using the longer wavelength light. Then the substrate is transported to the second platen and polished until a second endpoint is detected using the shorter wavelength light. This procedure provides an accurate endpoint determination even if there are large substrate-to-substrate variations in the initial thickness of the deposited layers.

In order to explain this advantage, it should be noted that substrate-to-substrate variations in the initial thickness of the layer being polished can result in an erroneous endpoint detection. Specifically, if the thickness variations exceed the peak-to-peak thickness ΔD of the first optical system, then the endpoint detection system may detect the endpoint in the wrong cycle of the interference signal. In general, an endpoint detector that uses a longer wavelengths will have a lower resolution. Specifically, there will be fewer fringes in the interference signal, and, consequently, the polishing apparatus will not be able to stop as accurately at a desired final thickness. However, the longer wavelength results in a larger peak-to-peak thickness ΔD (see Equation 7). The longer wavelength provides a greater tolerance for substrate-to-substrate variations in the initial thickness of the layer being polished, i.e., the endpoint is less likely to be improperly detected in the wrong cycle of the intensity signal. Conversely, an endpoint detector that uses a shorter wavelength will have higher resolution but lower tolerance for initial thickness variations.

The long wavelength at the first polishing station provides a larger peak-to-peak thickness ΔD, and thus a larger tolerance for substrate-to-substrate layer thickness variations. Although the first endpoint detector does not have as high a resolution as the second endpoint detector, it is sufficiently accurate to stop polishing within a single peak-to-peak thickness ΔD' of the second optical system. The shorter wavelength at the second polishing station provides a more accurate determination of the thickness at the final endpoint. Thus, by using optical systems with different wavelengths in sequence, particularly with the second wavelength being shorter than the first wavelength, polishing may be stopped more precisely at the desired endpoint. In addition, accurate endpoint detection can be achieved even if substrate-to-substrate variations in the initial thickness of the layer being polished exceed the peak-to-peak thickness ΔD' of the second optical system.

This procedure can be implemented in the embodiments of the CMP apparatus described above that use multiple optical systems at one or more of the polishing stations. For example, the procedure could be implemented by polishing the substrate serially at each station, and using only-one of the two available optical systems at each station.

In addition, the procedure could be implemented during polishing of a substrate at a single polishing station that uses two optical systems, as illustrated in FIGS. 1–15. For example, the first optical system could be used to detect the endpoint that would otherwise be detected at the first polishing station, and the second optical system could be used to detect the endpoint that would otherwise be detected at the second polishing station. Alternately, the first optical system can be used to detect an intermediate polishing point. After the intermediate polishing point is detected, the second optical system can be used to detect the endpoint that would otherwise be detected at the first polishing station. Furthermore, the procedure could be implemented at a single station using a single optical system in which the effective wavelength of the light source can be modified. For example, the light source could be set to generate a light beam having a first wavelength, and after the first endpoint or intermediate polishing point is detected, the light source could generate a second light beam having a second, different wavelength.

Although stations 22*e* and 22*e*' are illustrated in FIG. 16 as the first and second polishing stations, the procedure can be implemented using other combinations of polishing stations. For example, the first and second polishing station can include optical systems that use the same longer wavelength light beam, and the third polishing station 25*e*" can include an optical system that uses the shorter wavelength light beam. In this case, the procedure is performed at the second and third polishing stations.

In addition, the polishing accuracy of the CMP apparatus can be further improved with additional optical systems that use ever shorter wavelengths. For example, third polishing station 22*e*" can include an optical system that generates a light beam with a wavelength that is even shorter than the wavelength of light beam 70*e*'.

In addition, one or more optical systems can be used to detect an intermediate polishing point at which some polishing parameter is to be changed. Specifically, after polishing away a certain thickness of the surface layer, it may be advantageous to modify the polishing parameters, such as the platen rotation rate, carrier head rotation rate, carrier head pressure, or slurry composition, to optimize the polishing rate or uniformity. For example, in a polishing station including two optical systems, the first optical system could be used to detect some intermediate polishing point, and the second optical system could be used to detect the endpoint. Alternately, in a polishing station including a single optical system with a variable wavelength light source, the optical system would first detect the intermediate polishing point at one wavelength, and then detect the endpoint at a different wavelength. Finally, the intermediate polishing point can be detected in a polishing station that includes a single optical system which does not change the wavelength of the light beam. In this implementation, the same optical system would be used serially, first detecting the intermediate polishing point to trigger a change in the polishing parameters, and then detecting the endpoint.

The present invention has been-described in terms of a preferred embodiment. The invention, however, is not limited to the embodiment depicted and described. Rather, the scope of the invention is defined by the appended claims.

What is claimed is:

1. A chemical mechanical polishing apparatus to polish a layer of a substrate, comprising:

a first polishing station;

a first optical system including a first light source to generate a first light beam to impinge the substrate as it is polished at the first polishing station, the first light beam having a first effective wavelength, and a first sensor to measure light from the first light beam that is reflected from the layer to generate a first intensity signal;

a second polishing station;

a second optical system including a second light source to generate a second light beam to impinge on the substrate as it is polished at the second polishing station, the second light beam having a second effective wavelength that differs from the first effective wavelength, and a second sensor to measure light from the second light beam that is reflected from the layer to generate a second intensity signal; and at least one processor to determine an intermediate polishing point at the first polishing station from the first intensity signal and a polishing endpoint at the second polishing station from the second intensity signal.

2. The apparatus of claim 1, wherein the first effective wavelength is greater than the second effective wavelength.

3. The apparatus of claim 2, wherein the first light beam has a first wavelength and the second light beam has a second wavelength that is shorter than the first wavelength.

4. The apparatus of claim 3, wherein the first wavelength is between about 800 and 1400 nanometers.

5. The apparatus of claim 3, wherein the second wavelength is between about 400 and 700 nanometers.

6. The apparatus of claim 1, further comprising a third polishing station and a third optical system including a third light source to generate a third light beam to impinge on the substrate as it is polished at the third polishing station, the third light beam having a third effective wavelength, and a third sensor to measure light from the third light beam that is reflected from the substrate to generate a third intensity signal.

7. The apparatus of claim 6, wherein the third effective wavelength is smaller than the second effective wavelength.

8. The apparatus of claim 6, wherein the third effective wavelength is equal to the second effective wavelength.

9. The apparatus of claim 1, further comprising a carrier head to move a substrate between the first and second polishing stations.

10. The apparatus of claim 1, wherein each polishing station includes a rotatable platen with an aperture through which one of the first and second light beams can pass to impinge the substrate.

11. The apparatus of claim 10, wherein each polishing station includes a polishing pad supported on a corresponding platen, each polishing pad having a window through which one of the first and second light beams can pass to impinge the substrate.

12. A method of chemical mechanical polishing, comprising:

polishing a substrate at a first polishing station;

generating a first intensity signal by directing a first light beam having a first effective wavelength onto the substrate and measuring light from the first light beam reflected from a layer in the substrate;

detecting an intermediate polishing point from the first intensity signal;

after detection of the intermediate polishing point, generating a second intensity signal by directing a second light beam having a second effective wavelength onto the substrate and measuring light from the second light beam reflected from the layer of the substrate, wherein the second effective wavelength differs from the first effective wavelength; and detecting a polishing endpoint from the second intensity signal.

13. The method of claim 12, wherein the first effective wavelength is larger than the second effective wavelength.

14. The method of claim 13, wherein the first light beam has a first wavelength and the second light beam has a second wavelength that is shorter than the first wavelength.

15. The method of claim 14, wherein the first wavelength is between about 800 and 1400 nanometers.

16. The method of claim 14, wherein the second wavelength is between about 400 and 700 nanometers.

17. The method of claim 12, wherein the step of generating the second intensity signal occurs at the first polishing station.

18. The method of claim 12, further comprising transferring the substrate to a second polishing station after detection of the polishing endpoint.

19. The method of claim 18, further comprising:

after detection of the polishing endpoint, generating a third intensity signal by directing a third light beam having a third effective wavelength onto the substrate and measuring light from the third light beam reflected from the substrate; and detecting a second polishing endpoint from the third intensity signal.

20. The apparatus of claim 19, wherein the third effective wavelength is smaller than the second effective wavelength.

21. The apparatus of claim 19, wherein the third effective wavelength is equal to the second effective wavelength.

22. The method of claim 19, further comprising transferring the substrate to a third polishing station after detection of the second polishing endpoint.

23. The method of claim 12, further comprising modifying a polishing parameter after detection of the intermediate polishing point.

* * * * *